US010249144B2

(12) United States Patent
Irwin, Jr.

(10) Patent No.: US 10,249,144 B2
(45) Date of Patent: Apr. 2, 2019

(54) GENERATION OF GAME OUTCOMES AND A SINGLE VALIDATION FILE THAT INCLUDES THE GAME OUTCOMES FOR A PLURALITY OF INSTANT TICKET SUB GAMES HAVING DIFFERENT PRIZE LEVELS

(71) Applicant: Hydra Management LLC, New York, NY (US)

(72) Inventor: Kenneth E. Irwin, Jr., Dawsonville, GA (US)

(73) Assignee: Hydra Management LLC, New York, NY (US)

( * ) Notice: Subject to any disclaimer, the term of this patent is extended or adjusted under 35 U.S.C. 154(b) by 0 days.

(21) Appl. No.: 15/424,077

(22) Filed: Feb. 3, 2017

(65) Prior Publication Data

US 2017/0228966 A1 Aug. 10, 2017

Related U.S. Application Data

(60) Provisional application No. 62/292,120, filed on Feb. 5, 2016.

(51) Int. Cl.
*G07F 17/32* (2006.01)

(52) U.S. Cl.
CPC ..... *G07F 17/329* (2013.01); *G07F 17/3241* (2013.01); *G07F 17/3258* (2013.01)

(58) Field of Classification Search
CPC ..... G07F 17/329; G07F 17/3241; G07F 17/3258; G07F 17/3223; G07F 17/3225
See application file for complete search history.

(56) References Cited

U.S. PATENT DOCUMENTS 4,842,278 A * 6/1989 Markowicz ..... A63F 3/081 463/18
5,042,809 A * 8/1991 Richardson ..... G07F 17/32 273/460
5,048,833 A 9/1991 Lamle
5,249,800 A 10/1993 Hilgendorf et al.
5,280,909 A 1/1994 Tracy
(Continued)

FOREIGN PATENT DOCUMENTS

EP 1394752 A2 3/2004
WO 2010070652 A1 6/2010
WO 2015162533 A1 10/2015

OTHER PUBLICATIONS

Int'l Search Report and Written Opinion dated May 15, 2017 in PCT Application No. PCT/US2017/016502.
(Continued)

*Primary Examiner* — David L Lewis
*Assistant Examiner* — Matthew D Hoel
(74) *Attorney, Agent, or Firm* — Panitch Schwarze Belisario & Nadel LLP

(57) ABSTRACT

A production method and system are provided for enabling the secure sharing of a common prize fund across multiple lottery or contest games and/or sub games. By sharing common inventory control and validation files the multiple games will validate on existing lottery or contest systems without the need for any software or hardware modifications. These methods and systems enhance the games, as well as potentially expand the consumer base for the games.

9 Claims, 12 Drawing Sheets

(56) References Cited

U.S. PATENT DOCUMENTS 5,324,035 A * 6/1994 Morris ..... A63F 3/081 273/139
5,655,961 A * 8/1997 Acres ..... G07F 17/32 463/25
5,741,183 A * 4/1998 Acres ..... G07F 17/32 463/16
5,820,459 A * 10/1998 Acres ..... G07F 17/32 463/25
5,836,817 A * 11/1998 Acres ..... G07F 17/32 463/26
5,842,921 A * 12/1998 Mindes ..... G06Q 50/34 463/16
6,017,032 A * 1/2000 Grippo ..... A63F 3/08 273/138.1
6,110,043 A * 8/2000 Olsen ..... G07F 17/32 463/27
6,186,521 B1 * 2/2001 Divoky ..... A47D 15/006 280/33.992
6,210,276 B1 * 4/2001 Mullins ..... A63F 3/00157 463/17
6,231,445 B1 * 5/2001 Acres ..... G07F 17/32 463/16
6,254,480 B1 * 7/2001 Zach ..... A63F 3/081 463/16
6,554,283 B2 * 4/2003 Vancura ..... G06Q 30/02 273/292
6,565,434 B1 * 5/2003 Acres ..... G07F 17/32 463/25
6,588,747 B1 7/2003 Seelig
6,634,946 B1 * 10/2003 Bridgeman ..... G07F 17/32 463/13
6,793,219 B2 9/2004 Higginson
6,935,948 B2 * 8/2005 Wright ..... G06Q 30/0212 273/138.1
7,204,756 B2 * 4/2007 Jubinville ..... G07F 17/32 463/17
7,213,811 B2 5/2007 Bozeman
7,322,885 B1 * 1/2008 Luciano, Jr. ..... G07F 17/32 273/138.1
7,407,436 B2 8/2008 Groz
7,416,484 B1 * 8/2008 Nelson ..... G07F 17/3244 273/138.1
7,530,896 B2 * 5/2009 Gauselmann ..... G07F 17/32 463/26
7,631,872 B2 * 12/2009 Roemer ..... G07F 17/32 273/273
7,635,302 B2 * 12/2009 Wright ..... G06Q 30/0212 273/139
7,635,304 B2 12/2009 Wright
7,780,523 B2 * 8/2010 Baerlocher ..... G07F 17/3258 463/16
7,857,693 B1 * 12/2010 Johnson ..... G07F 17/3293 463/13
7,901,287 B2 * 3/2011 Simms ..... G07F 17/32 463/16
8,216,045 B2 7/2012 Wright et al.
8,348,754 B2 1/2013 Jackson et al.
8,408,995 B2 * 4/2013 Uchiyama ..... G07F 17/3244 463/27
8,845,409 B2 9/2014 Kane et al.
8,932,129 B2 * 1/2015 Powell ..... G07F 17/3244 463/22
9,039,508 B1 * 5/2015 Arnone ..... G07F 17/3227 463/16
9,039,510 B2 * 5/2015 Uchiyama ..... G07F 17/3244 463/19
10,009,180 B2 * 6/2018 Hamman ..... H04L 9/3247
10,027,487 B2 * 7/2018 Hamman ..... H04L 9/3247
10,121,321 B2 * 11/2018 Irwin ..... G07F 17/3258
2002/0155876 A1 * 10/2002 Taylor ..... G07F 17/32 463/17
2003/0080507 A1 5/2003 Higginson
2003/0125108 A1 7/2003 Groz
2005/0164767 A1 7/2005 Wright
2005/0164770 A1 7/2005 Wright
2005/0227759 A1 10/2005 Dolezal
2006/0183536 A1 * 8/2006 Gagner ..... G07F 17/32 463/26
2007/0060276 A1 * 3/2007 Monahan ..... G06Q 30/02 463/17
2010/0093419 A1 4/2010 Wright et al.
2010/0144418 A1 6/2010 Luciano, Jr. et al.
2010/0190541 A1 7/2010 Lazar
2010/0197376 A1 * 8/2010 Kerr ..... C07K 14/705 463/17
2010/0291986 A1 * 11/2010 Roemer ..... G07F 17/32 463/9
2014/0080563 A1 * 3/2014 Johnson ..... G07F 17/3227 463/13
2014/0187305 A1 7/2014 Irwin, Jr.
2016/0217657 A1 * 7/2016 Halter ..... G07F 17/3258
2017/0287274 A1 * 10/2017 Takeda ..... G07F 17/3255
2018/0253938 A1 * 9/2018 Monahan ..... G06Q 30/02

OTHER PUBLICATIONS

Time to privatize the lottery, The Hill, Dec. 2014, downloaded from webpage:<http://thehill.com/blogs/congress-blog/civil-rights/226500-time-to-privatize-the-lottery>, Download date: Dec. 2017, 3 pages.
Advanced Encryption Standard (AES), Federal Information Processing Standards Publication 197, Nov. 2001, Downloaded from web page: http://nvlpubs.nist.gov/nistpubs/FIPS/NIST.FIPS.197.pdf>, Download date: Dec. 5, 2017, 51 pages.
Written Opinion dated May 16, 2018 in Int'l Application No. PCT/US2017/016502.
Written Opinion dated Feb. 5, 2018 in Int'l Application No. PCT/US2017/016502.

* cited by examiner

200

| | | | |
|---|---|---|---|
| $1 | Retail Cost | 6.08 | Overall Odds of Winning (1:n) |
| 1,000,000 | Pool Size | 10,000,000 | Total Ticket Quantity |
| 65% | Prize Fund Percentage | $6,500,000 | Prize Fund |

201

| Prize Structure | | | | |
|---|---|---|---|---|
| Win | % Winners | Winners per Game | Prize Value | Odds 1 In: |
| $2 | 10.59900% | 1,059,900 | $2,119,800 | 9.43 |
| $5 | 4.55788% | 455,788 | $2,278,940 | 21.94 |
| $10 | 1.00626% | 100,626 | $1,006,260 | 99 |
| $20 | 0.20000% | 20,000 | $400,000 | 500 |
| $50 | 0.08000% | 8,000 | $400,000 | 1,250 |
| $100 | 0.01000% | 1,000 | $100,000 | 10,000 |
| $200 | 0.00500% | 500 | $100,000 | 20,000 |
| $1,000 | 0.00020% | 20 | $20,000 | 500,000 |
| $2,500 | 0.00010% | 10 | $25,000 | 1,000,000 |
| $50,000 | 0.00001% | 1 | $50,000 | 10,000,000 |
| | | | | |
| | 16.4585% | 1,645,845 | $6,500,000 | 6.08 |

202

| Pool Structure (10 Pools/Game) | | | | |
|---|---|---|---|---|
| Win | % Winners | Winners per Pool | Prize Value | Odds 1 In: |
| $2 | 10.59900% | 105,990 | $211,980 | 9.43 |
| $5 | 4.55788% | 45,579 | $227,894 | 21.94 |
| $10 | 1.00626% | 10,063 | $100,626 | 99 |
| $20 | 0.20000% | 2,000 | $40,000 | 500 |
| $50 | 0.08000% | 800 | $40,000 | 1,250 |
| $100 | 0.01000% | 100 | $10,000 | 10,000 |
| $200 | 0.00500% | 50 | $10,000 | 20,000 |
| $1,000 | 0.00020% | 2 | $2,000 | 500,000 |
| $2,500 | 0.00010% | 1 | $2,500 | 1,000,000 |
| $50,000 | 0.00001% | 0 | $0 | 10,000,000 |
| | | | | |
| | 16.4585% | 164,585 | $645,000 | 6.08 |

FIG. 10
(Prior Art)

203

| | | | |
|---|---|---|---|
| *Varies* | Retail Cost | 6.08 | Overall Odds of Winning (1:n) |
| 100 | Pool Size | 10,000,000 | Total Ticket Quantity |
| 65% | Prize Fund Percentage | $6,500,000 | Prize Fund |

204

| Pool Structure-A | | | | |
|---|---|---|---|---|
| Win | % Winners | Winners per Pool | Prize Value | Odds 1 In: |
| $2 | 10.59900% | 7 | $14 | 9.43 |
| $5 | 4.55788% | 3 | $15 | 21.94 |
| $10 | 1.00626% | 1 | $7 | 99 |
| $20 | 0.20000% | 0 | $3 | 500 |
| $50 | 0.08000% | 0 | $3 | 1,250 |
| $100 | 0.01000% | 0 | $1 | 10,000 |
| $200 | 0.00500% | 0 | $1 | 20,000 |
| $1,000 | 0.00020% | 0 | $0 | 500,000 |
| $2,500 | 0.00010% | 0 | $0 | 1,000,000 |
| $50,000 | 0.00001% | 0 | $0 | 10,000,000 |
| | | | | |
| | 16.4585% | 11 | $42 | 6.08 |

FIG. 11

GENERATION OF GAME OUTCOMES AND A SINGLE VALIDATION FILE THAT INCLUDES THE GAME OUTCOMES FOR A PLURALITY OF INSTANT TICKET SUB GAMES HAVING DIFFERENT PRIZE LEVELS

CROSS-REFERENCE TO RELATED APPLICATION

This application claims the benefit of U.S. Patent Application No. 62/292,120, filed Feb. 5, 2016, the disclosure of which is hereby incorporated herein by reference in its entirety.

FIELD OF THE INVENTION

The present invention is the innovation of control mechanisms for enabling contests or lotteries preferably utilizing tickets or documents with variable indicia determining winning and losing tickets or documents that are hidden under a Scratch-Off Coating (SOC) comprised of a very small number of tickets or documents sharing a larger prize pool and thereby enabling games including a very small number of tickets or documents to nevertheless enjoy the benefits of substantial prizes. Specifically, this innovation resolves the problem of producing customized games or contests for small groups with correspondingly small sales while still offering large prizes on a fixed or parimutuel basis.

BACKGROUND

Lottery games have become a time honored method of raising revenue for state and federal governments the world over. Traditional scratch-off and draw games have evolved over decades, supplying increasing revenue year after year. However, after decades of growth, the sales curves associated with traditional games seem to be flattening out. This flattening of lottery sales curves is typically attributed to a fixed base of consumers that routinely purchase lottery products with very few new consumers choosing to participate in the lottery marketplace. Various analyses of state lottery sales data tend to support the hypothesis that lotteries rely heavily on an existing consumer base and more specifically on lottery "super users." Three states (Rhode Island, South Dakota and Massachusetts) had 2014 lottery sales that topped $700 per capita. While ten states had per capita sales below $100, per capita sales for all state lotteries averaged almost $250. Demographically speaking, this existing base of lottery consumers is aging with younger consumers showing very little interest in participating in existing lottery offerings. Thus, the potential for ever-increasing lottery sales is increasingly problematic with the existing fixed base of consumers saturated. Consequently, both lotteries and their service providers are presently searching for new forms of gaming.

In addition to flattening sales, a static lottery consumer base is often cited as exploiting problem gamblers with various legislatures debating restrictions or probations being placed on lotteries. For example, "Stop Predatory Gambling", which advocates an end to state-sponsored gambling recently stated: "State lotteries have a business model that's based on getting up to 70 to 80 percent of their revenue from 10 percent of the people that use the lottery . . . ." In Minnesota, a pending bipartisan bill would require 25% of lottery billboards to be dedicated to a warning about the odds of winning, cautions about addiction, and information on where problem gamblers can seek help.

In an attempt to diversify their base and increase sales, United States lotteries have come to appreciate the virtues of producing games with more entertainment value that can be sold at a premium price. For instance, ten-dollar instant ticket (i.e., scratch-off) games with higher paybacks and more ways to win now account for over $5 billion a year in United States lottery sales. But by their nature, high-volume, generic, higher priced instant games are a minor part of overall game offerings and although they have their place, they have limited potential for assisting in consumer base diversification. The high-priced and high-volume nature of these games tends to drive the lotteries to generic (i.e., proven) type of play (i.e., appealing to existing player base) with very little experimentation possible. Lastly, these higher priced and high-volume games also typically add little unique entertainment value relative to lower priced instant tickets and consequently do not to attract many new consumers.

In addition to lotteries, there are numerous contests and raffles that are classically used both as promotions and alternative methods for charitable organizations to raise funds. However, unless these contests and raffles are very large in scale they will by necessity offer only smaller prizes, thereby limiting their broad appeal.

Moreover, as gaming technology and systems continue to evolve and become more sophisticated, numerous new types of games and products become available that require discrete new methods of funding and enabling. Gaming trends no longer support gaming to the masses, rather differentiation through information is favored with gaming systems tracking and targeting using such concepts as: predictive value, frequency, platform game choice, average bet, etc. However, tracking and targeting gaming platforms to these concepts necessitates segmenting the player base into smaller and smaller groups or pools with each group or pool too small to sustain a viable prize fund by itself.

Some attempts have been made to enable funding of smaller lottery and other types of games. U.S. Pat. Nos. 6,588,747; 6,793,219; 7,213,811; 7,635,302; 7,635,304; 8,216,045; and 8,845,409 and United States Application Publications 2005/0164767 and 2010/0093419 all teach offering optional secondary or additional games or tiers with lottery tickets with a correspondingly smaller player base and associated prize fund. However, these optional secondary games as envisioned simply employ a subset prize fund of the primary game that is preordained with the creation of the primary game and do not anticipate prize funds across multiple smaller games. U.S. Pat. No. 7,407,436 teaches expanding the expected return of a game by dividing funds received into both a prize pool and an investment fund where assets are purchased with the investment fund, such that the overall expected return of the game over a given period of time is positive when compared to a static prize fund; but, this reference fails to specifically address increasing prize funds for multiple small lots of games or tickets. United States Application Publication 2005/0164767 teaches enhancing a prize fund by selling the risk to an outside entity; but again, this reference fails to specifically address increasing prize funds for small lots of games or tickets.

United States Application Publications 2003/0080507 and 2003/0125108 disclose that for the gaming industry, such as lottery-type games, games can be more exciting for consumers if larger payouts (e.g., one billion dollars) are offered. These larger payouts, with correspondingly long odds of winnings, are not necessarily won during any specific game genera play, but would essentially be offered as an additional drawing. Consequently these larger prizes require some entity to assume the risk. The '108 application discloses the use of financial instruments to hedge the risk with the '507 application expanding on the risk mitigation concept by essentially having insurance companies issue an insurance policy covering the large prize. However, neither of these applications addresses a fixed prize fund where prizes are financed solely by ticket sales, nor do they envision financing mid-tier prizes (e.g., $50, $100, $500, etc.) for small lots of games or tickets. Furthermore, neither application addresses the vexing problem of backward compatibility of their disclosed larger payout drawings with existing lottery validation systems.

Finally, United States Application Publication 2014/0187305 teaches sharing of a common prize fund across multiple Internet games with the various games employing different play styles, indicia, etc. by all drawing from a common prize fund. However, the '305 application still envisions a fixed prized fund with a priori knowledge of all game details (e.g., number of games, number of plays, types of prizes, etc.) established at the time of prize fund creation. While this type of a priori knowledge of game details is possible for Internet gaming due to the low production costs (i.e., practically zero) of per game play, the '305 application does not readily accommodate games with physical embodiments like instant tickets with a SOC where production costs and logistics are higher and economies of scale assume large print runs in the tens of millions. Additionally, the '305 application does not envision accommodating existing lottery retail venues of physical ticket redemption.

Thus, it is highly desirable to develop gaming systems platforms that provide methods of funding new gaming opportunities, particularly more customized and consequently smaller volume games. Ideally these gaming platforms should accommodate smaller pools of tickets that are not necessarily manufactured at the same time thereby allowing for flexibility and creativity for game designers to tailor games to a wide variety of small targeted segments as they become available hereunto not served by existing gaming offerings, in turn appealing to a broader base of consumers.

SUMMARY OF THE INVENTION

Objects and advantages of the invention will be set forth in part in the following description, or may be apparent from the present description, or may be learned through practice of the invention.

In accordance with aspects of the invention, secure gaming systems are established that enable multiple individual games from pico ("pico"<10), nano (10<"nano"≤100), and micro (100<"micro"≤10,000,000) through standard macro ("macro">10,000,000) game sizes to share a common prize fund. In certain embodiments the multiple individual games may be instant lottery ticket games with a SOC hiding the indicia.

In a particular embodiment, multiple pico, nano, micro, etc., games are linked to a common fixed prize fund where the prize payout is assured to be within predefined limits yet offering chances at large prizes (e.g., $500,000) on games with very few or even only one player. This linking of pico, nano, and micro games to a common (larger) prize fund is accomplished in a manner that ensures backward compatibility with existing validation systems such as lottery instant ticket systems.

In another embodiment, the pico, nano, and/or micro games are created on-demand and linked to a pre-established prize fund that maintains security against pick-out—i.e., an insider attempting to illicitly leverage the on-demand gaming feature to pick-out winning tickets in advance of purchase. This particular embodiment accommodates dynamic game allocation—i.e., where a priori knowledge of the games to be linked or pooled to the common prize fund is not necessarily known at the time of prize fund creation. This embodiment also has the advantage of supporting gaming systems employing contextual marketing to gaming prospects.

In yet another embodiment, multiple pico, nano, and/or micro games share a predefined pay-in criteria (e.g., percentage of retail sales), thereby enabling differing prizes from game-to-game so long as each game's payout is within predefined criteria. In a preferred embodiment, these pay-in and payout criteria are weighted via the retail costs of game play. Additionally, this predefined pay-in criteria may be utilized to create a progressive prize fund similar to progressive jackpots for slot machines (e.g., U.S. Pat. Nos. 5,048,833; 5,280,909; 5,249,800; and 8,348,754, the disclosures of which are hereby incorporated herein by reference in their entireties) where a macro, micro, nano, or pico instant ticket's top prize entitles the winner to a percentage of the accumulated progressive jackpot from multiple games. In a preferred embodiment, the percentage of the progressive jackpot that the winner receives is determined by the ticket retail price.

In all of these embodiments, the linked pico, nano, micro, and/or macro games share a common prize fund and gaming validation system. The essential concept of the invention is to utilize the common prize fund and gaming and validation system to enable mid- and high-tier prize awards for multiple unique games with small volumes.

Described are a number of validation mechanisms and methodologies that provide practical details for reliably producing secure pooling of prize funds across multiple games. Although the examples provided herein are primarily related to instant tickets, it is clear that the same methods are applicable to any type of small number specialized games (e.g., American Legion Post drawing) pooling a common prize fund.

Various embodiments of the present invention relate to the following aspects:

1. An electronic computerized system for sharing a common prize fund across at least two different instant ticket sub games of a game, wherein:

a first portion of the sub games is assigned winning status and a second portion larger than the first portion is assigned losing status;

the sub games are digitally generated by a common shuffle of variable indicia;

the sub games are manufactured in at least one print run to produce physical tickets;

the respective winning and losing status of each of the sub games is displayed via printed variable indicia hidden under a Scratch-Off Coating (SOC) on unplayed physical tickets;

the sub games are divided into packs with prize funds balanced by grouping sets of packs into pools, wherein the pools are supportable by an Expected Value (EV) of the game; and at least one process creates divergent thread reiterative shuffles during subsequent ticket generation to balance the common prize fund to a predetermined expected value;

such that a final shuffle for at least one sub game will produce each of a corresponding validation data file, ship file, and stolen pack list, and physical tickets.

2. The system of aspect 1, wherein an interim variable image file is generated for each sub game.
3. The system of aspect 1, wherein different prize tiers are respectively associated with different sub games.
4. The system of aspect 1, wherein different pack sizes are printed for and are respectively associated with different sub games.
5. The system of aspect 4, wherein when the packs comprise smaller sized packs and larger sized packs, at least one phantom non-winning ticket entry having a phantom ticket number is included in the validation data file and the ship file of at least one smaller sized pack whether or not the phantom ticket number is ever physically printed, thereby ensuring backward compatibility.
6. The system of aspect 5, wherein the at least one phantom non-winning ticket entry is listed as a non-winner in the validation data file.
7. The system of aspect 1, wherein various sub games are respectively associated with different retail pricing.
8. The system of aspect 1, wherein the sub games share a common game number with sub game differentiation achieved by respectively associated different pack numbers.
9. The system of aspect 1, wherein different game numbers are respectively associated with different sub games.
10. The system of aspect 1, wherein respective phantom pack numbers are associated with at least one sub game is in the validation data file and the ship file at the time of printing a first sub game, thereby enabling the respective phantom pack numbers to function as digital place holders for future printing of at least one additional sub game.
11. The system of aspect 10, wherein the phantom pack number place holders that remain unproduced after an associated additional sub game is printed are voided in the already produced ship file and the already produced validation data file by adding any unused pack numbers to a stolen pack list.
12. The system of aspect 1, wherein isolated variable indicia pools are maintained for and to be respectively associated with at least two sub games.
13. The system of aspect 1, wherein at least one sub game variable indicia image file, ship file, and validation data file, is separately generated from the at least one other sub game variable indicia image file, ship file, and validation data file.
14. The system of aspect 13, wherein the at least one sub game variable indicia image file, ship file, and validation file is encrypted for secure storage.
15. The system of aspect 14, wherein the at least one sub game variable indicia image file, ship file, and validation file is encrypted via the Advanced Encryption Standard (AES).
16. The system of aspect 14, wherein the game variable indicia image file, the ship file, and the validation file are encrypted with a separate encryption key different than the variable indicia, the validation data file, and the ship file of the at least one other sub game.
17. The system of aspect 13, wherein a stolen pack list is separately generated from the at least one other sub game variable indicia image file, ship file, and validation data file.
18. The system of aspect 17, wherein the stolen pack list is encrypted for secure storage.
19. The system of aspect 18, wherein the stolen pack list is encrypted via the Advanced Encryption Standard (AES).
20. The system of aspect 17, wherein the stolen pack list is encrypted with a separate encryption key different than the variable indicia, the validation data file, and the ship file of the at least one other sub game.
21. The system of aspect 1, wherein an interim image file is generated for each sub game that contains winning and losing variable indicia for all possible prize levels of the sub game, with multiple variable indicia for each prize fund.
22. The system of aspect 21, wherein winning variable indicia that were generated in excess of what is specified by the prize fund are removed from the interim image file via a plucking algorithm.
23. The system of aspect 1, wherein cleartext validation file data available for audit has at least a portion of its ticket-by-ticket order shuffled.
24. The system of aspect 23, wherein the shuffling of the cleartext validation file data is performed by a Linear Congruential Generator (LCG) or Mersenne Twister algorithm.
25. The system of aspect 1, wherein when the subgames are of smallest size, smaller size and larger size, the pool of all sub games has a size that is determined by the sub game of the smallest size.
26. The system of aspect 1, wherein prize balancing is achieved by a reserved prize fund portion that is created by reserving a small portion of the prize fund from multiple games that is pooled in a common progressive jackpot.
27. The system of aspect 26, wherein the reserved prize fund portion is 1%.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings:

FIG. 10 is an exemplary illustration of a typical, prior art instant ticket prize fund subdivided into pools;

FIG. 11 is an exemplary illustration of a preferred embodiment according to the present invention of an instant ticket prize fund subdivided into nano pools; and, FIG. 12 is a system architecture diagram corresponding to the flowcharts of FIG. 5, FIG. 7, and FIG. 9.

DETAILED DESCRIPTION

Before describing the present invention, it may be useful to first provide a brief description of the current state of the art of instant ticket production and validation. The concept is to ensure that a common lexicon is established of existing systems prior to describing the present invention. This description of the current state of the art of instant ticket production and validation is provided in the discussions of FIG. 1 through FIG. 3.

Figure 1:
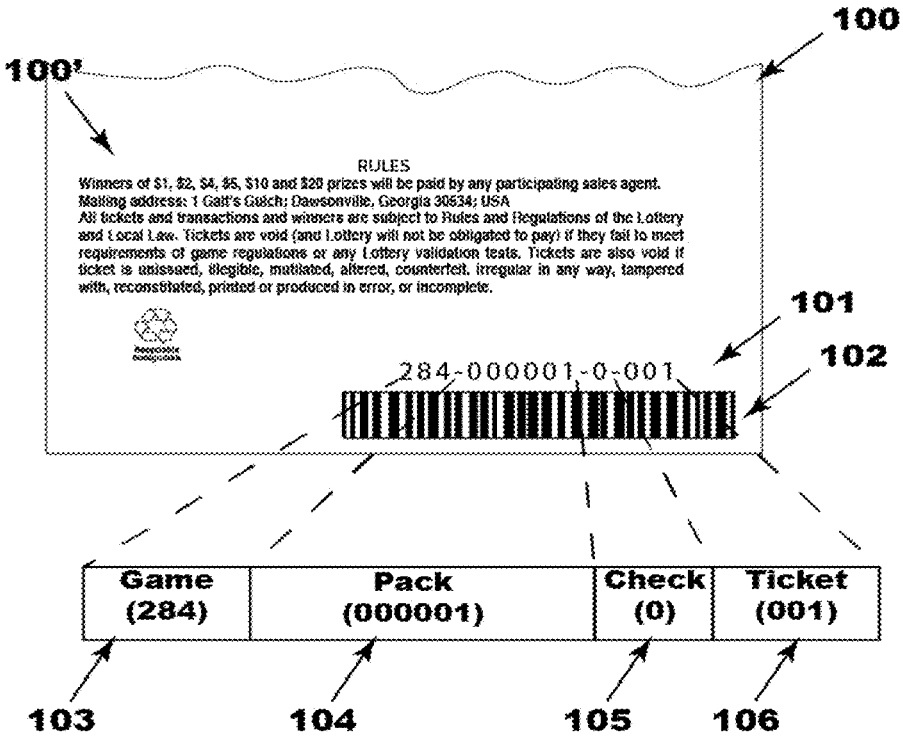
FIG. 1 (Prior Art)
FIG. 1 is a back elevation view of a representative example of a traditional, prior art lottery-type instant ticket showing a human readable inventory control number and an associated machine readable barcode.

FIG. 1 depicts a representative example of the variable human readable inventory control number 101 and the associated barcode 102 on the back 100' of a traditional macro printed lottery-type instant ticket 100. As shown in FIG. 1, the variable printed human readable inventory control number and the associated barcode are imaged on the ticket back 100' and therefore accessible (by design) to the retailer prior to purchase of the ticket. Also presented in FIG. 1 is a taxonomy of a typical instant ticket's human readable inventory control number's 101 data: starting with a three or four decimal digit game number 103 identifying the game, followed by a variable length pack number 104 (six decimal digits as shown in FIG. 1), a one or two digit modulo check number 105, and a variable digit ticket number 106 (three decimal digits as shown in FIG. 1) uniquely identifying the ticket in a pack. The taxonomy of the instant ticket's barcode 102 data is similar to the human readable inventory control number 101 with the barcode 102 and human readable images embodying identical inventory control data 103 through 106; however, the barcode 102 can embody other data in addition to the inventory control data.

As previously stated, the instant ticket inventory control data 103 through 106 typically found on the back 100' of a lottery ticket 100 are accessible via human readable inventory control number 101 and barcode 102 to the retailer and others prior to purchase and play of the ticket. This is because, as its name implies, the instant ticket inventory control data 103 through 106 embodied as human readable inventory control number 101 and barcode 102 indicia are used for tracking the individual ticket through its life cycle of production, warehouse storage, shipping, pack activation by the retailer, and sale to and redemption by the consumer. Therefore, for security reasons against retailer pick-out, there is no cleartext win or lose information embedded in the instant ticket human readable number 101 or machine-readable barcode 102. However, in some embodiments, win or lose validation information is included in the machine-readable barcode 102, but this information is always encoded as ciphertext and never accessible in cleartext from an unplayed ticket.

Figure 2:
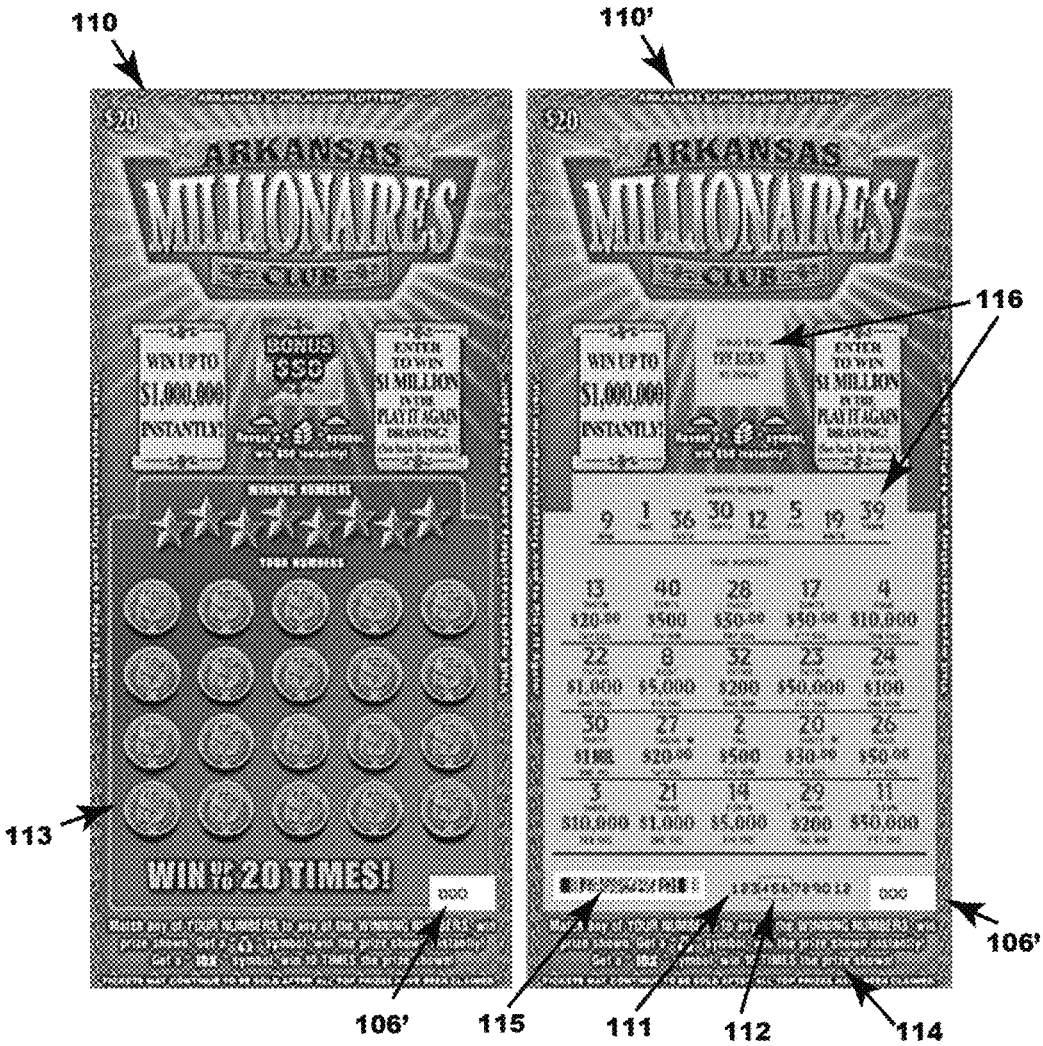
FIG. 2 (Prior Art)
FIG. 2 is a front elevation view of the representative example of a traditional, prior art lottery-type instant ticket of FIG. 1 with views of both validation data secured by a SOC and validation data accessible after the SOC is removed.

FIG. 2 depicts representative examples of prior art front elevation views of a virgin (i.e., unplayed) instant lottery ticket 110 and a played instant lottery ticket 110' with all SOC removed. As shown in FIG. 2, the variable validation number 111 is imaged beneath the ticket's SOC 113 and is therefore only accessible after the ticket has been purchased and played. Typically included as part of the validation number 111, is a series of three or four boxed decimal digits 112 that can be used to verify that the ticket has been properly played during validation and redemption. Again, since the validation number 111 and associated boxed digits 112 are covered by the SOC of unpurchased tickets, this data is theoretically inaccessible until the ticket is purchased and played. In addition to the validation number 111, human readable game play variable indicia 116 (sometimes referred to herein simply as "indicia") are also imaged under the SOC, providing the human game play and associated win or lose information. In some embodiments, a validation barcode 115 is also imaged under the SOC, thereby enabling expedited redemption of winning tickets by scanning. As before, this validation barcode 115 is covered by the SOC on unsold tickets, thereby preventing it from being scanned until the ticket is purchased and played.

Also typically found on both ticket front views 110 and 110' is the imaged ticket number 106' that should be identical to the ticket number 106 (FIG. 1) imaged on the ticket back 100'. This double back 100' and front 110 and 110' (FIG. 2) ticket number 106 and 106' imaging is presented to aide the retailer in inventory control, as well as to provide a quality assurance check during production to ensure that the front and back imagers are in synchronization.

Figure 3:
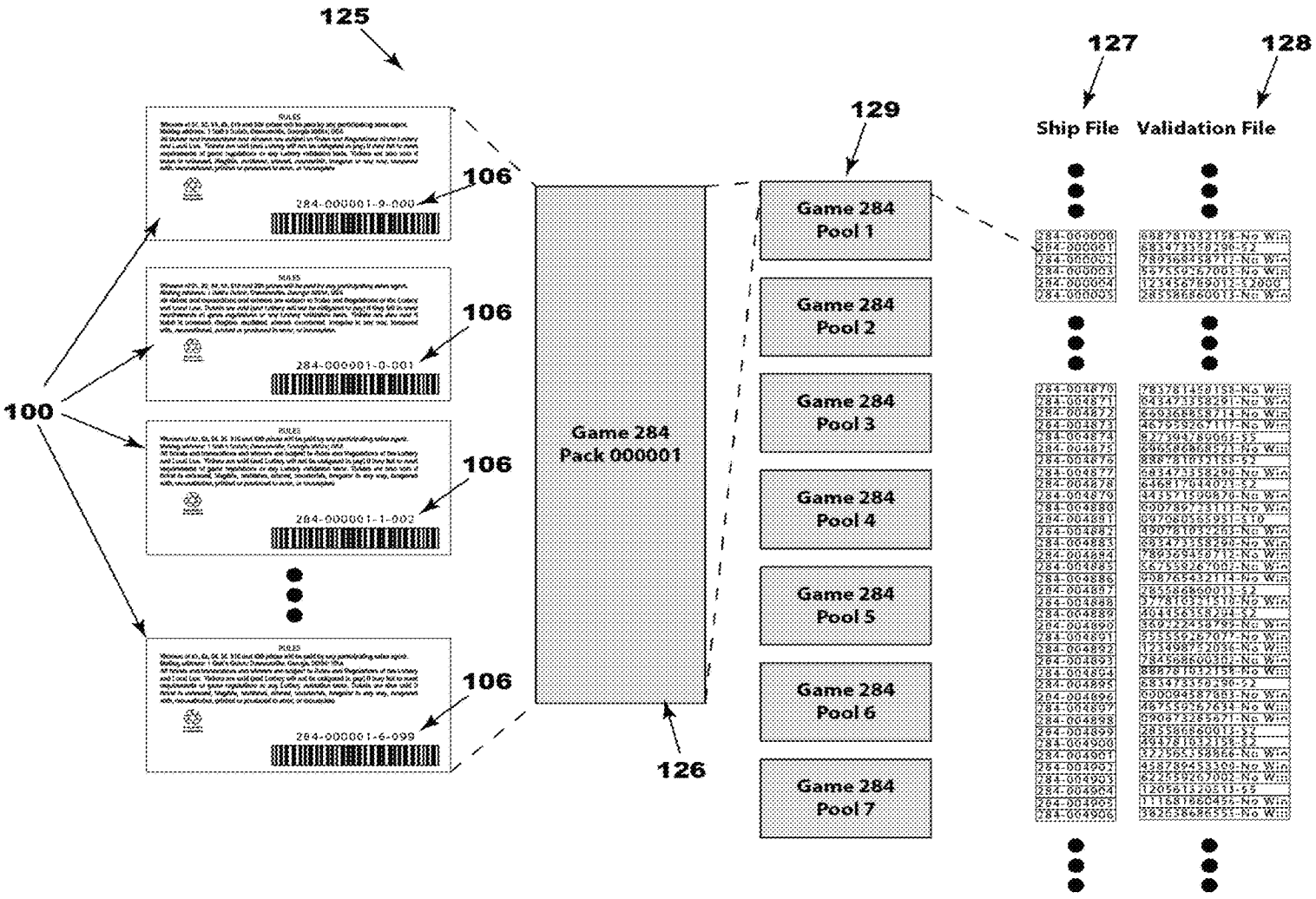
FIG. 3 (Prior Art)
FIG. 3 is a block diagram of a representative example of traditional, prior art lottery-type instant tickets as logistically arranged with respect to the activation and validation system.

Referring to FIG. 3, at the system level 125, logistical tracking, activation, and validation of lottery-type instant tickets 100 are accomplished by grouping tickets together in packs 126. The number of tickets per pack (one-hundred as illustrated by the human readable ticket numbers 106, incrementing from "000" to "099") will vary depending on the game and ticket retail value, but all tickets 100 in a pack 126 will typically have sequential inventory control numbers 106 and 101 (FIG. 1). There are several reasons for arranging lottery-type instant tickets in packs. A primary reason is that instant tickets 100 (FIG. 3) are ordered and shipped in packs 126 with the pack 126 being the fundamental unit of reconciliation. Since instant tickets 100 are shipped in packs 126, the pack 126 is also the fundamental unit of activation on the overall instant ticket system 125—i.e., there is typically no individual (ticket) level of activation; the smallest quantization of activation on a typical instant ticket system 125 is at the pack 126 level. Thus, when a retailer receives a new pack of tickets 126, he or she must first activate the pack 126 on the system 125 before placing the tickets on sale. Pack 126 level activation thereby enables instant tickets to be shipped via common carrier since un-activated or stolen packs 126 would be automatically flagged on the system 125 with any tickets 100 in the pack 126 flagged when redemption was attempted.

In addition to shipping, reconciliation and activation, some games may be structured such that there are a specified minimum number and/or types of winners within a pack 126. In these embodiments, the arrangement of winning tickets is not truly random, but are randomly distributed within a defined structure to ensure that all retailers receive approximately the same number of low- and mid-tier winners per pack as well as to aid in ensuring sufficient cash is on hand for paying low- and mid-tier prizes.

A given number of packs 126 is then arranged on the system 125 as a pool 129. The purpose of a pool 129 is to reconcile all low- and mid-tier (and possibly high-tier) prizes into a predetermined prize structure. While the size of a pool 129 can vary from game-to-game, it is essential that a pool 129 be sufficiently large to inhibit tracking unsold winning tickets by the public.

All of the produced packs 126 for a given game are logged in a digital ship file 127 by the ticket manufacturer and loaded on the system 125 prior to the game being placed on sale. The ship file contains a listing of all the manufactured packs 126 identifying (typically by omission) any pack 126 numbers that were destroyed or omitted in the manufacturing process. As a game is placed on sale the ship file is routinely expanded with information such as: "pack 'X' shipped to retailer 'Y', "pack 'X' activated," "pack 'X' stolen," etc. Thus, the ship file enables logistical tracking of all manufactured packs 126 in an instant ticket game; however, the ship file 127 does not contain any win or lose information and cannot be linked (without appropriate cryptographic seeds or keys) to the validation data file 128 (sometimes referred to herein as simply the "validation file").

The validation file 128 contains the validation codes 111 (FIG. 2) for all tickets within a game with the validation codes 111 effectively providing pointers to the prize value (if any) of a ticket 110 and 110' on the system 125 (FIG. 3). As previously discussed, the validation code 111 (FIG. 2) is effectively inaccessible with unplayed or unsold tickets due to it being covered by SOC 113. In some embodiments, the validation code is also embodied in a barcode 115 hidden under the SOC 113 that cannot be scanned until the ticket is played; in other embodiments there is additional validation file 128 information (other than inventory control) in the ticket back barcode 102 (FIG. 1) in an encrypted format where the boxed digits 112 (FIG. 2) enable decryption, etc. However, in all embodiments, the cleartext validation code 111 is inaccessible on unplayed or unsold tickets 100. Therefore, the security of the system 125 (FIG. 3) is derived from the validation file 128 being unassociated with the ship file 127, as well as the physical unplayed tickets' inventory control information 101 and 102 (FIG. 1).

Both the ship file 127 (FIG. 3) and the validation file 128 are generated by the instant ticket manufacturer before the tickets are shipped to the lottery. All lottery logistical and validation systems 125 currently require the ship file 127 and validation file 128 to be loaded on the system 125 prior to instant tickets being shipped to retailers and placed on sale. Once loaded onto the system 125, the basic validation file 128 typically cannot be altered (other than flagged additions—e.g., redeemed tickets in the validation file, stolen packs in the stolen pack list, etc.), thereby ensuring the integrity of the instant ticket game and its predetermined payout.

Reference will now be made in detail to examples of the invention, one or more embodiments of which are illustrated in the drawings. Each example is provided by way of explanation of the invention, and not meant as a limitation of the invention. For example, features illustrated or described as part of one embodiment, may be used with another embodiment to yield still a further embodiment. This invention includes these and other modifications and variations that come within the scope and spirit of the invention.

Figure 4:
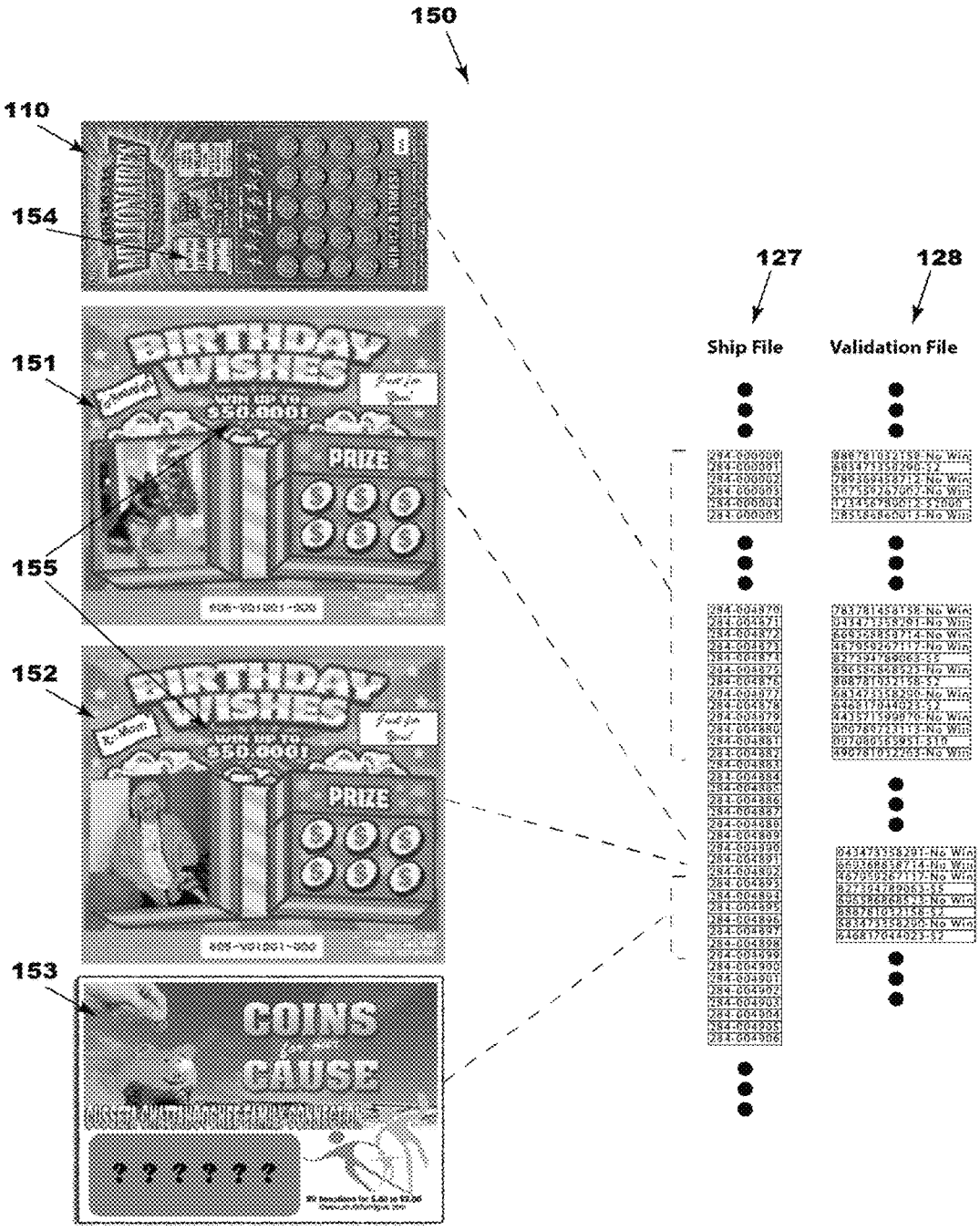
FIG. 4 is a block diagram providing a schematic graphical overview of a first embodiment as applied to reliably producing secure pooling of a prize fund across multiple pico, nano, micro, and macro games.

A first embodiment of the present invention for reliably and securely sharing a common prize fund across multiple games is provided in FIG. 4. In this first embodiment of the system 150 of FIG. 4, an instant ticket prize fund, ship file 127, and validation file 128 are generated for a standard macro (i.e., ≥10,000,000) instant ticket 110 print run with extra pack entries added to the ship file 127 and validation file 128 for pico (i.e., <10) games 151 and 152 as well as nano (i.e., 10<"nano"≤100) game 153. Thus, in the embodiment of the system 150, pico games 151 and 152 and nano game 153 are printed at the end of the standard macro game 110 press run with prize fund sharing and logistical validation file compatibility achieved by simply keeping the same game number 103 (FIG. 1) and format of inventory control numbers 103 through 106 of game 100 or 110 across pico games 151 and 152, as well as nano game 153. However, the ticket front display and overprint 110, 151, 152, and 153 (FIG. 4) as well as variable indicia (not shown) differ for the pico games 151 and 152, the nano game 153, as well as the macro game 110. The underlining assumption is that most consumers would not detect (or care) about the shared inventory control and validation format of their pico games 151 and 152 and nano game 153 with a macro game 110, especially when it is realized that the shared format enables their pico games 151 and 152 and nano game 153 to share the prize fund enabled by the large volume of tickets of the macro game 110 with an associated higher prize fund. Thus, by inserting pico games 151 and 152 and nano game 153 into a prize fund pool for the macro game 110, the pico games 151 and 152 and nano game 153 can offer better odds (e.g., 1:5 to win a prize) and a higher payout (e.g., top prize of $50,000 as illustrated in 151 and 152) than would be possible with pico, nano, or micro games, each with its own discrete prize fund.

Thus, pico games 151 and 152 and nano game 153 become a part of the prize fund of the larger macro game 110 by simply occupying special pack numbers 104 and ticket numbers 106 (FIG. 1) in the ship file 127 and validation data file 128 for the macro game 110 (FIG. 4). These pack numbers 104 and ticket numbers 106 (FIG. 1) are reserved for the pico games 151 and 152 and nano game 153 (FIG. 4) at the time the prize fund of the macro game 110 is generated. Consequently, a single pack number 104 (FIG. 1) would represent the entire production of pico game 151 (FIG. 4) and a second single pack number 104 (FIG. 1) would represent the entire production of the pico game 152 (FIG. 4) with several pack numbers 104 (FIG. 1) representing the nano game 153 (FIG. 4). Lottery retailer validation of winning tickets would then be accomplished by the usual process with the central site system processing the tickets for the pico games 151 and 152 and nano game 153 as winning tickets from the larger prize fund of the macro game 110. Different prize levels (e.g., "$1,000,000" top prize 154 for the macro game 110 and "$50,000" top prize 155 for the pico games 151 and 152) are accommodated by reserving multiple prize levels in the overall prize fund (e.g., "$1,000,000" 154 for the macro game 110 and "$50,000" 155 for the pico games 151 and 152), some of which may not be used in some sub games or may not be awarded prizes at all. For example, if the "$50,000" top prize 155 can be exclusive to the pico games 151 and 152 and the prize generation shuffle does not select a top prize winner for the tickets associated with the pico games, then the $50,000 top prize 155 will not be awarded. These reserved prize levels for different games need not only be associated with high-tier prizes. For example, a "Lucky 7's" themed game typically features a prize award of "$7" while a "Crazy 8's" game typically features a prize award of "$8". If the macro game were "Lucky 7's" with an associated nano game being "Crazy 8's," the "$7" and "$8" prizes would only appear in the appropriately themed game.

In one embodiment, some prize levels are simply withheld (i.e., programmed to never be selected for some sub games) by flagging certain pack numbers as not eligible for certain prizes. For example, the pico games 151 and 152 are illustrated with a top prize 155 of $50,000, with the macro game 110 having a top prize 154 of $1,000,000. In this embodiment, the $1,000,000 top prize 154 would simply be flagged as ineligible on the system 150 for the pico games 151 and 152 (and therefore not imaged), with the $50,000 prize also occurring in the macro game 110 as a high-tier prize, but not the highest-tier prize for that game.

In a preferred embodiment, some prizes will only be allocated for some sub games—e.g., the $50,000 top prize 155 for the pico games 151 and 152. In this embodiment, the system 150 prize fund generator will flag any missing prize tier awards (e.g., the $50,000 top prize 155 of FIG. 4 in the previous example) and balance the overall prize fund to the desired payout (e.g., 65% of sales) by increasing the number of winning low-tier and mid-tier tickets in the overall prize fund. Conversely, if the system 150 prize fund generator shuffle happens to award a significant high-tier prize to a pico game 151 or 152 or to a nano game 153, the number of winning low-tier and mid-tier tickets in the overall prize fund will automatically be reduced to balance the overall payout to the desired amount. This preferred embodiment thereby enables the system 150 prize fund generator to feedback and analyze its own shuffle output and correspondingly award low-tier and mid-tier prizes along divergent threads once significant prize awards are known so as to achieve the same desired payout.

As would be apparent to one skilled in the art in view of the present disclosure, there are many possible combinations of macro, micro, nano, and pico games sharing a common prize fund that may omit various categories—e.g., macro and nano games only, or macro, nano, and pico games, etc. In some embodiments, there may be a sufficient number of nano and/or pico games that there are no macro or micro games sharing the common prize fund. These embodiments are desirable, assuming that a sufficiently large enough volume of various nano and/or pico games is available to sustain an overall prize fund with significant prizes.

Figure 5:
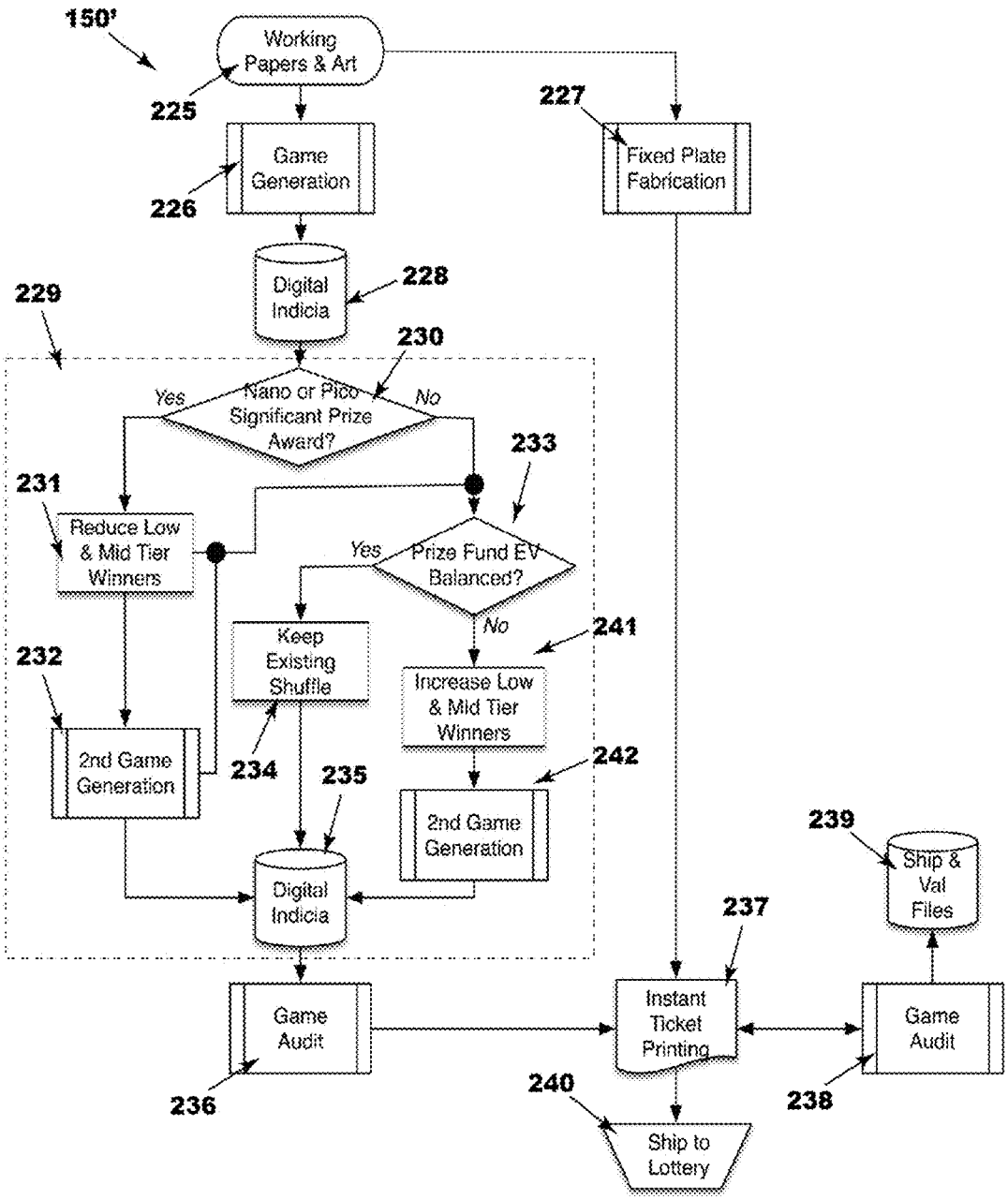
FIG. 5 is a flowchart providing a schematic graphical overview of the first embodiment of FIG. 4 as applied to enabling pooling of a prize fund across multiple pico, nano, micro, and macro games via reiterative shuffles in the game generation and shuffle process and how the embodiment seamlessly integrates into the existing prior art production process.

FIG. 5 illustrates the previous preferred embodiment of the system 150 in a flowchart format 150'. Existing standard practice game generation functionality is shown along with the preferred invention addition of divergent thread reiterative shuffles highlighted in the dashed area 229, representing additional digital computer processing according to this invention. As shown in the figure, the instant ticket game starts with generation of working papers (i.e., per a contract between the lottery and the instant ticket provider, as well as any pico and nano game purchasers) and associated ticket artwork 225 that the lottery and provider agree and sign. The executed working papers 225 are then used to specify game generation 226 programming (i.e., the digital variable indicia imaging of instant tickets and associated winner or loser distribution), as well as the manufacture of any fixed plates 227 (e.g., flexographic, offset, etc.) used to possibly print the display and security areas of instant tickets. After game generation 226 is completed, variable indicia (i.e., the numbers, symbols, artwork, etc., that reveal if a ticket is a winner after the SOC is removed) are digitally imaged 228 for each instant ticket of the print run and saved.

At this point, the additional digital computer processing 229 enabled by the disclosed invention is added to the instant ticket production process and system 150'. First, the previously generated digital indicia 228 is audited 230 to specifically determine if any pico and nano games 151 through 153 (FIG. 4) included in the game generation 226 (FIG. 5) has been awarded a significant prize award with the initial shuffle such that the prize award would result in the macro game 110 (FIG. 4) having an insufficiently financed prize fund with respect to its Expected Value (EV), also known as "total payout"—i.e., the actual payout of the macro game prize fund would be less than specified in the executed working papers 225 (FIG. 5). Depending on the outcome of this computational audit and evaluation 230, the logic thread of the game generation process will be directed down one of two logical forks. One fork (i.e., "Yes"—231 and 232) is evoked if a pico or nano game 151 through 153 (FIG. 4) has been dealt a significant prize, and the other fork (i.e., "No"—233, FIG. 5) is evoked if no significant prize was awarded in a pico or nano game 151 through 153 (FIG. 5).

Assuming a pico or nano game 151 through 153 (FIG. 4) has been dealt a significant prize, the logical thread proceeds with step 231 (FIG. 5) reducing or plucking the number of low-tier and mid-tier winners in the other game(s) to exactly balance the overall prize fund to match the EV. This balancing process is achieved by reducing the total number of low-tier and mid-tier winners in the macro game 110 (FIG. 4), such that the overall prize fund EV pays out as specified. The reduction process causes either the elimination of some prizes and/or the reduction of some prizes from higher tier to lower tier winners. Either way, the reduction in winners would have an insignificant impact on the overall game play style due to the large number of tickets printed for the macro game 110 combined with any other games (that did not encounter a significant prize award) compared to the relatively small number of reductions.

In one embodiment, the reduction process in winners of the other game(s) is executed on the post-shuffled arrangement of winners in the other game(s) with the selected reduced winning ticket variable indicia either being substituted for non-winning or reduced prize value variable indicia. In a second, preferred embodiment, the reduction process in winners of the other game(s) is executed on the pre-shuffled prizes to be awarded in the macro game 110—i.e., the raw specified number of winners for each prize tier for the entire game prior to being assigned to a specific ticket. The second embodiment is preferred, since it theoretically ensures a more homogeneous distribution of winners throughout the other game(s), as well as compliance with any non-random prize distributions as specified by the working papers. Assuming the second preferred embodiment is implemented, once the reduced number of winners process is completed for the other game(s) in which the nonstandard significant win did not occur, a second-generation digital shuffle 232 occurs (FIG. 5), allocating the revised number of winners to the tickets in the other games (i.e., no revised shuffle for the pico or nano game that received the significant prize) with the resulting digitally imaged data 235 archived for the printing process or preferably routed for a second prize fund balancing audit 133. Thus, the overall prize fund pays out to its EV by revising the number of winners in sub games without a nonstandard significant win.

If no pico or nano game 151 through 153 (FIG. 4) were dealt a significant prize, the logical thread proceeds with secondary audit 233 (FIG. 5), which audits and reviews the overall prize fund with respect to the specified EV to determine if the prize fund needed adjustment to properly balance to the specifications of the working papers 225. Depending on the outcome of this review, the logic thread of the game generation process will now be directed down a second logical fork unique to this invention. One fork (i.e., "Yes"—234) is evoked if the EV of all of the pico and/or nano game(s) 151 through 153 (FIG. 4) significantly matches the EV as specified in the working papers 225 (FIG. 5). The other fork (i.e., "No"—241 and 242) is evoked if the pseudorandom distribution of the shuffle did not include a sufficient number of winners to ensure that the pico and/or nano game(s) 151 through 153 (FIG. 4) or if a modified (i.e., plucked or reshuffled) macro game from steps 231 and 232 pays out to expected EVs. In the event the fork is selected where the prize fund balances out to the EV (i.e., "Yes"—234), then no modifications would be required and the existing shuffle(s) 234 of the digitally imaged variable indicia is archived for the printing process 235. However, if the step 233 determines that in order for the prize fund to balance out to the EV, the low-tier and mid-tier prizes of the other sub game(s) must be adjusted via a process (i.e., "No") to increase the number of low-tier and mid-tier winners in these game(s) to balance the overall prize fund to match the EV via step 241 which audits and reviews all games in the generation to determine where the anomaly occurred. This type of anomaly can occur, since this invention essentially spreads a common prize fund across multiple games where the normal shuffle may result in a distribution that is incompatible with the specifications of the working papers 225 for each game. Regardless of the reason, once it is determined at step 233 that all of the games in the generation do not match the EV, the games are audited at step 241 to find the anomaly. Once the anomaly is determined, procedure at step 241 either modifies the winners in the post-shuffled arrangement of winners (one embodiment) or reduces the number of winners in the pre-shuffled prizes to be awarded in the macro game—i.e., the raw specified number of winners for each prize tier for the entire game prior to being assigned to a specific ticket (the second, preferred embodiment). The second embodiment is preferred, since it theoretically ensures a more homogeneous distribution of winners throughout the other game(s), as well as compliance with any non-random prize distributions as specified by the working papers. Assuming the second, preferred embodiment is implemented, once the revised number of winners is determined for the game(s), a second-generation digital shuffle occurs at step 242, allocating the revised number of winners to the tickets in the games, with the resulting digitally imaged variable indicia data archived for the printing process at step 235.

Once the review 230 of the pico or nano game(s) and possible adjustment (steps 231, 232, 241, and 242) are completed and archived at step 235, the instant ticket production process returns to the existing standard of performing a game audit at step 236 on the archived digitally imaged indicia data at step 235, with the audited data ultimately transmitted to on-press digital images for printing the instant tickets at step 237 in association with the associated fixed plates generated at the start of this process at step 227. When the physical printing of step 237 is completed, a final audit of the printed product is conducted at step 238 with the correlated ship and validation files generated at step 239 after the audit. Once the final audit at step 238 is complete and the ship and validation files are generated at step 239, the physical tickets printed at step 237 and the ship and validation files of step 239 are dispatched to the lottery at step 240.

The preferred basic embodiments of the system 150 and 150' have the advantage of enabling differing odds for pico and/or nano games sharing a common prize fund with a macro game. As explained herein, these differing odds can be higher or lower than the macro game, depending on the specifications—e.g., a higher ticket price for the pico or nano games resulting in better payoff odds. The differing odds with potentially high top prizes become possible by the addition of the divergent thread reiterative shuffles invention as described regarding the process 229.

It should also be noted, that with the above embodiments of the system 150 and 150', the pack sizes may differ from the macro to the nano and pico sub games. Any differences in pack sizes can be accommodated in the ship and validation files by simply inserting phantom ticket entries (i.e., digital tickets that are never physically printed) that are all non-winners to make up the difference between the smaller pack(s) sizes and the largest pack size—e.g., pico sub games with only ten tickets to a pack would include forty phantom ticket entries in the ship and validation files for each pack, assuming that the largest pack size in the prize fund were fifty tickets. This addition of non-winning phantom ticket entries is necessary to ensure backward compatibility with existing lottery validation systems that assume a common size for all packs with the same game number 103 (FIG. 1).

While the embodiments of the system 150 and 150' have the advantage of simplicity in implementation, these embodiments also have numerous potential disadvantages primarily related to manufacturing and logistics. For example, the embodiments of the system 150 and 150' require that any pico, nano, or micro tickets be printed at the same time as a macro press run to ensure an accurate ship file. From a manufacturing perspective, this may be considered inefficient and problematic. Printing presses designed to extract maximum efficiencies from macro press runs rarely can be changed economically to print micro, nano, or pico game runs—with smaller runs being more readily accomplished with different printing technology. Additionally, there are potential problems with printing differently themed variable indicia and display overprints for the micro, nano, or pico games—e.g., the "BONUS $50" 116 (FIG. 2) display indicia feature of the macro game 110 would be inconsistent if utilized with the custom birthday card themed pico games 151 and 152 (FIG. 4). Aside from printing, the embodiments of the system 150 and 150' also require separate handling and distribution for micro, nano, or pico games that may not be readily compatible with the handling and distribution employed for macro runs.

Figure 6:
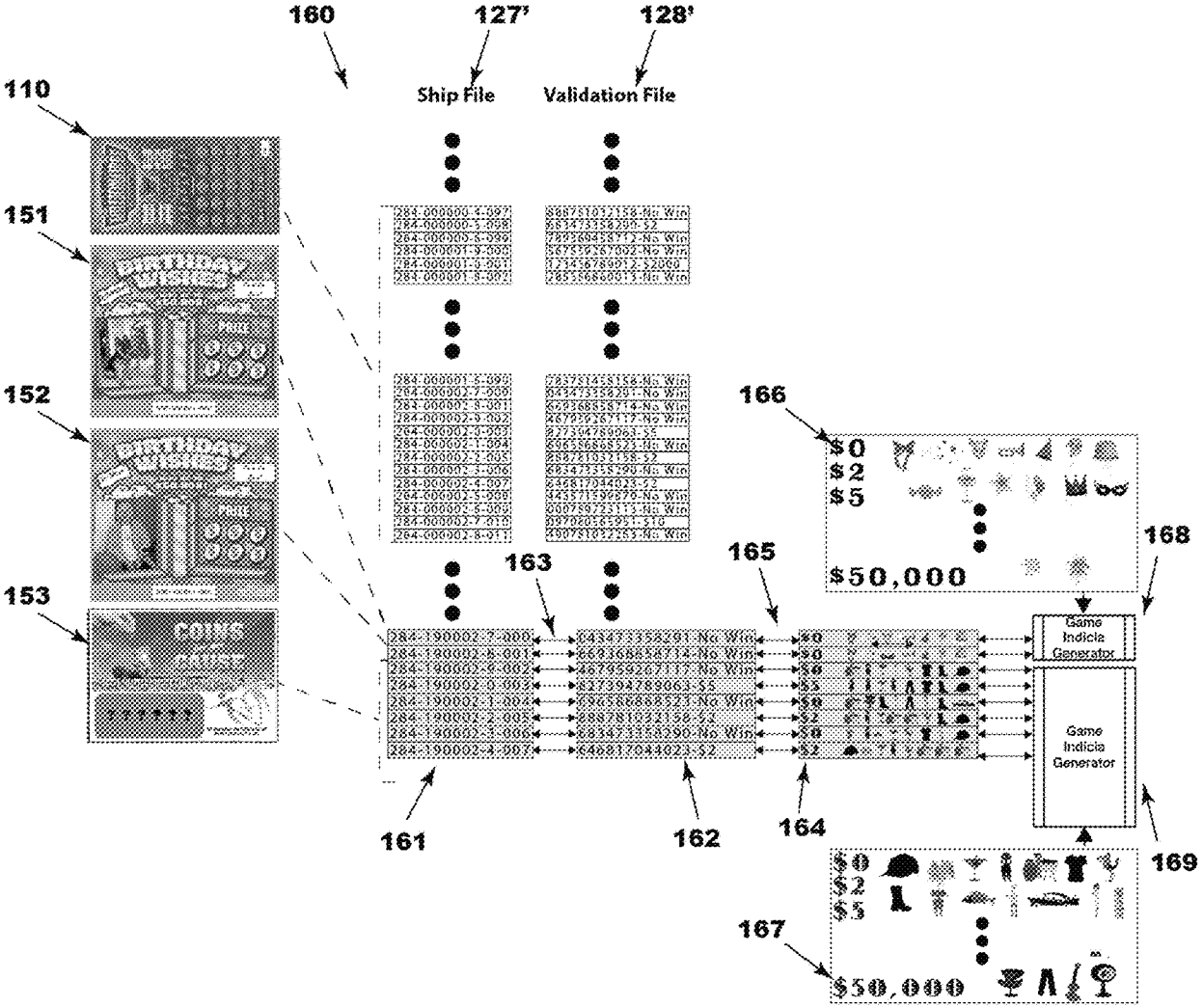
FIG. 6 is a block diagram providing a schematic graphical overview of a second embodiment for reliably producing secure pooling of a prize fund across multiple pico, nano, micro, and macro games.

Another system embodiment 160 of FIG. 6 overcomes many of the potential shortcomings of the first embodiments of the system 150 and 150' (FIG. 4 and FIG. 5) associated with manufacturing. Principally, when the ship file 127' and the validation file 128' (FIG. 6) are generated, extra packs or possibly pools are digitally created and registered virtually in the ship file 161 and the validation file 162. However, these virtual ship file 161 and validation file 162 entries are simply digital placeholders for future pico sub games 151 and 152 and/or nano sub game 153 and are not physically printed at the same time as the macro game 110, thereby only sharing the same prize fund. The generation of a complete ship file 127' and validation file 128' including virtual placeholder entries 161 and 162 allows the ship file 127' and validation file 128' to be loaded onto a legacy instant ticket validation system (e.g., system 125—FIG. 3), thereby enabling immediate sales for the macro sub game 110 (FIG. 6) and support for the shared prize fund, even if the pico sub games 151 and 152 and/or nano sub game 153 are not yet printed. Thus, the micro, nano or pico sub games are free to either be generated at the same time as the macro game 110 via a different printing system or sometime in the future with the smaller games' shared prize fund being buttressed by sales of the macro game 110.

By printing the pico sub games 151 and 152 and the nano sub game 153 at a later time and/or on a different press than the macro game 110, the problem of printing press efficiencies is greatly mitigated, since the press hardware and procedures that are optimum for the macro game 110 do not necessarily need to be employed for the micro or smaller sub games (e.g., the sub games 151 through 153) with the micro or smaller sub games utilizing printing technologies better suited to their smaller press run sizes. Furthermore, printing micro, nano, or pico print runs at a later time also allows for each sub game to be packaged and shipped separately with optimal equipment and packaging for the sub game size, thereby encountering no inefficiencies or reducing inefficiencies that typically arise when packaging and shipping micro, nano, or pico sub games on a macro sub game packaging and shipping system. Any pico, nano, or micro packs that are either not printed or destroyed during future production are voided from the preexisting ship file 127' by logging those packs as stolen and listed in a stolen pack list on the validation system 160.

With further reference to FIG. 6, problems associated with printing differently themed indicia for the macro, micro, nano, or pico games are also mitigated with the embodiment of the system 160, with the implementation of virtual placeholder ship entries 161 and validation entries 162. With this embodiment, separate variable indicia imaging files 164 can be created from a pool of appropriately themed variable indicia for the given pico sub game 166, nano sub game 167, or micro sub games, with each sub game's indicia pool isolated from the others, thereby ensuring consistency within a sub game. For example, if a given ticket of a pico sub game's shared prize fund's validation file 162 calls for a $5 winner, the associated pico generation system 168 will simply fetch suitable winning $5 indicia from the isolated pico pool 166 with the assurance that the fetched indicia will be compatible with the sub game's theme—e.g., birthday party themed indicia 166 for the pico games 151 and 152. Likewise, if a given ticket of a nano sub game's validation file 162 calls for a $5 winner, the associated nano generation system 169 would fetch suitable winning $5 indicia from the different nano pool 167, thereby providing fetched indicia with ensured compatibility with the sub game's theme.

Figure 7:
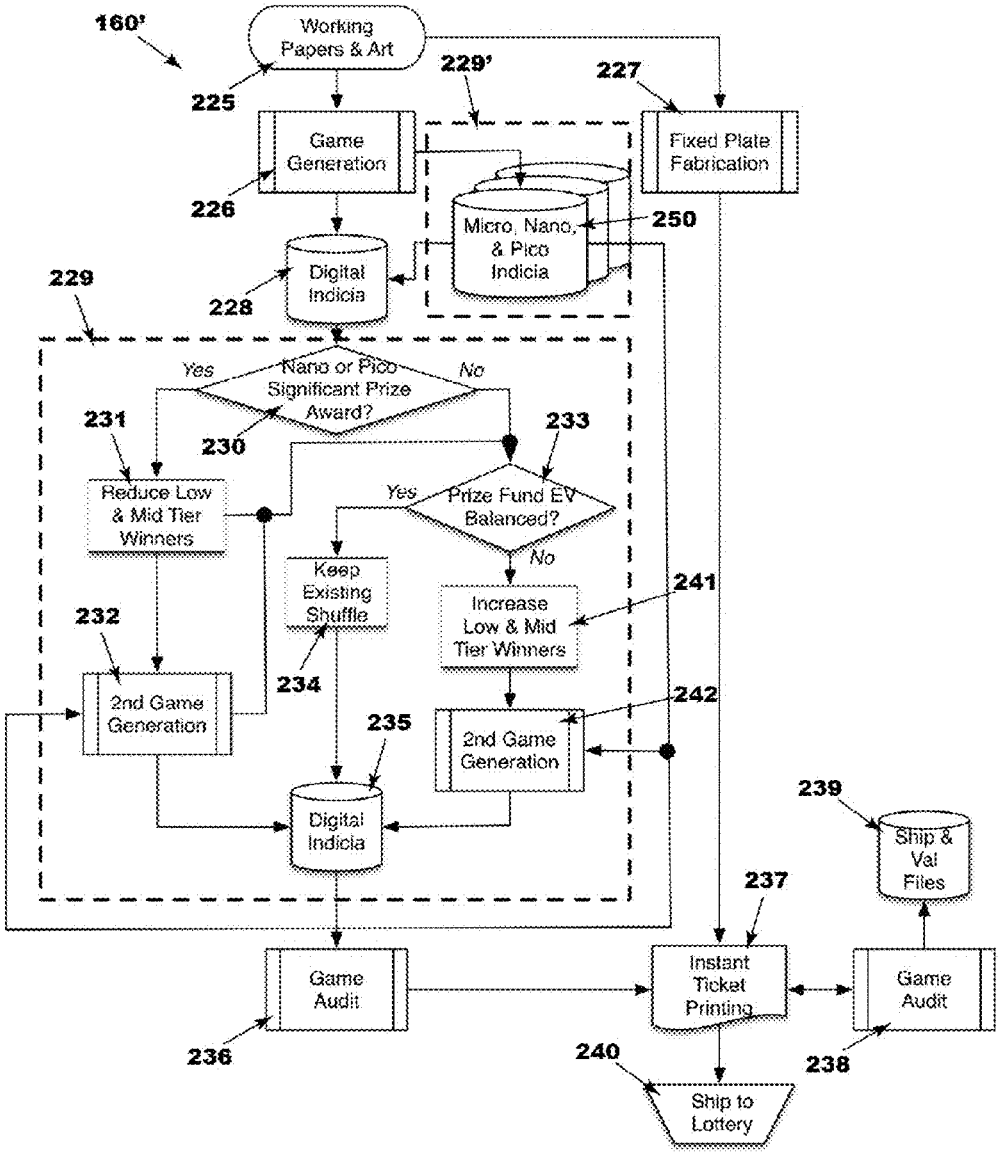
FIG. 7 is a flowchart providing a schematic graphical overview of the first embodiment of FIG. 5 as applied to enabling pooling of a prize fund across multiple pico, nano, micro and macro games via reiterative shuffles in the game generation and shuffle process as well as segregated variable indicia databases.

In one embodiment, the generation of the sub games' variable indicia image files occurs as part of the same process as the macro sub game shuffle. This embodiment essentially incorporates the same processes as illustrated in the system 150' of FIG. 5 with one exception being the ultimately archived digitally imaged variable indicia data 235 are structured to contain multiple different databases—i.e., as illustrated in FIG. 7, there is one database for the macro game 228 and individual databases 250 for each of the micro, nano, or pico games that share the common prize fund highlighted in dashed box 229' (also part of the invention). With this embodiment, the sub games' variable indicia image file 164, ship file 161, and validation file 162 (FIG. 6) generated in advance would be encrypted, preferably with a low-overhead symmetrical encryption algorithm, such as with the Advanced Encryption Standard (AES), well known to those skilled in this art, thereby reducing security threats resulting from these linked data being stored until the tickets are physically printed.

This relatively long term storage of any micro, nano, and pico sub games' variable indicia image file 164, ship file 161, and validation file 162 potentially can be problematic, since the ship file 161 and validation file 162 are generated at the same time as when the macro sub game is physically printed. The encryption of the indicia image data 235 provides additional security to mitigate this risk. In a preferred embodiment, the encryption keying of the micro, nano, and/or pico games would be implemented with separate encryption keys.

In another embodiment, the actual generation of the sub games' variable indicia image files 164 could occur at the time of printing the pico, nano, and/or micro sub games, rather than at the time the ship files 127' and 161 and validation files 128' and 163 are generated. This embodiment has the advantage of reducing potential security problems that could arise from maintaining an image file 164 with human readable win or lose variable indicia linked at schematically indicated at step 165 (FIG. 6) to a portion of a validation file 162 on a server over an extended time period with multiple sub games accessing the file. However, both of these embodiments have the potential disadvantages of requiring processing at the time of the press run, which can introduce errors or overload the production system. Generating a variable indicia file real time or generating it in advance and encrypting it could be problematic for both internal and external audits that are typically required by lotteries for instant ticket games. When it is realized that since the shared prize fund employs multiple games that may require multiple independent internal and external audits at different times, the potential audit problem's complexity grows practically exponentially.

Figure 8:
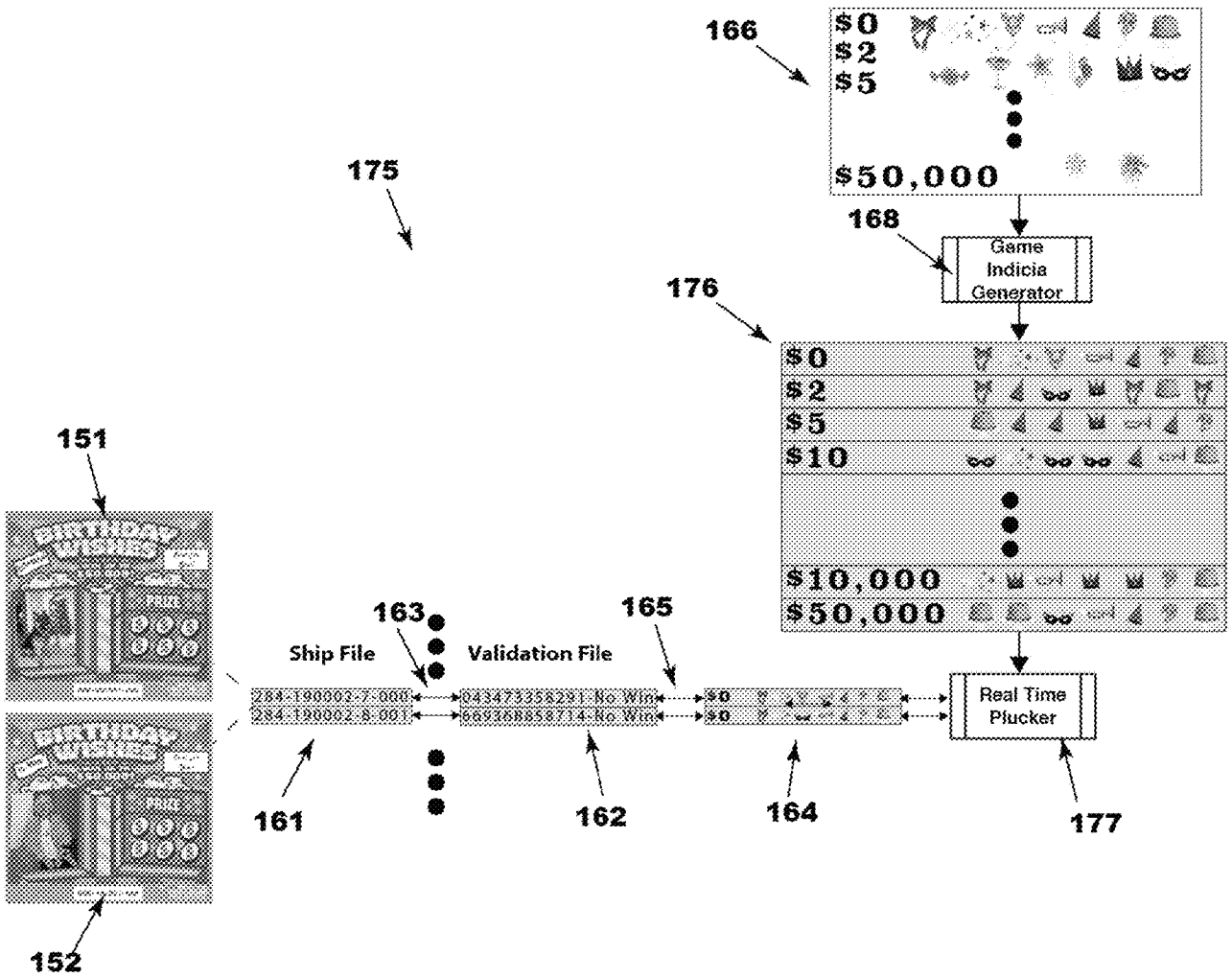
FIG. 8 is a block diagram providing a schematic graphical overview of a third, preferred, embodiment for reliably producing secure pooling of a prize fund across multiple pico, nano, micro, and macro games.

In the preferred embodiment of the system 175 of FIG. 8, both of the potential problems of real time print processing and auditing of the games are solved by first generating at step 168 an interim image file 176 for each game that contains winning and losing variable indicia for all possible prize levels of the game, with multiple variable indicia arrangements for each prize category to ensure the appearance of variability from ticket to ticket (not shown in FIG. 8). By generating an interim image file 176 with all possible game outcomes prior to a game's press run, both internal and external audits can be conducted to ensure that winning and non-winning variable indicia are correct. Since this interim image file 176 includes all possible outcomes, its persistence on servers over time poses no security risks, because the actual win or lose imaging would be performed by a separate pluck process at step 177 that would only execute during the game's printing process to generate the variable indicia imaging file 164 real time. The structure of plucking algorithms used at step 177 are inherently less complex than game indicia generation algorithms used at step 168, hence the real time execution of a pluck algorithm is less burdensome on the system and the processes of auditing and checking the pluck algorithm at step 177 to ensure proper prize selection are therefore greatly simplified.

In the context of this invention, the terms "pluck algorithm" or "plucking algorithm" refer to an algorithm that selectively removes or "plucks" excessive winning ticket images from a given game. The general concept is to initially generate more prizes in a given game than are specified by the working papers 225 (FIG. 9), thereby allowing for excessive prizes to be culled (i.e., plucked) from the database at a later time. Traditionally, plucking algorithms are utilized to compensate for waste during the printing process—i.e., extra (above the number specified by the working papers) winning tickets are imaged to ensure that a sufficient number of winning tickets are printed after press out-of-register and other printing errors responsible for press waste are taken into consideration. The overall concept is that the plucking algorithm culls excess winners (above the number specified by the working papers), ensuring a set of physically printed tickets with winners exactly within the specifications of the working papers 225. However, with this invention, plucking algorithms are employed to balance the micro, nano, or pico game winners to a specified outcome.

Figure 9:
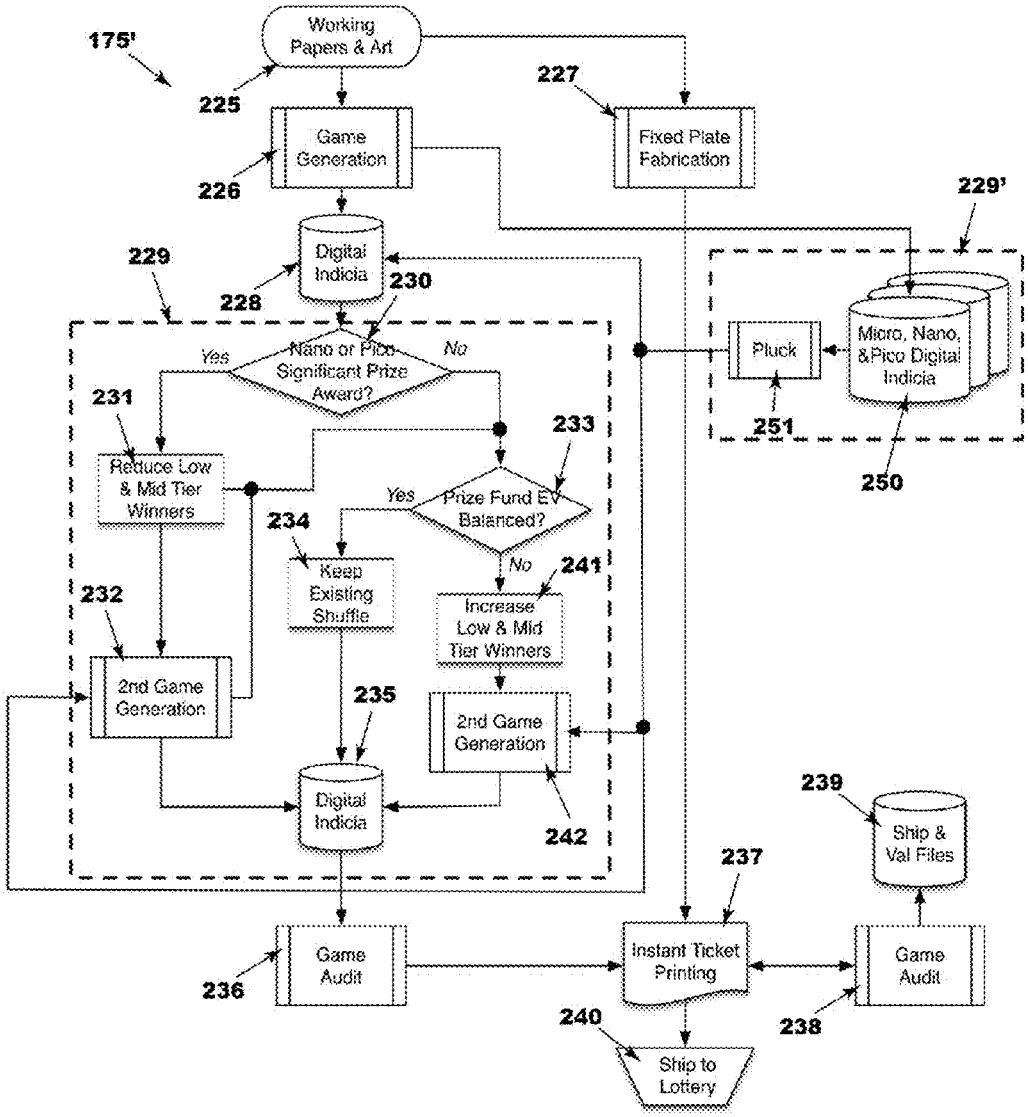
FIG. 9 is a flowchart providing a schematic graphical overview of the first embodiment of FIGS. 4 and 5 as applied to enabling pooling of a prize fund across multiple of pico, nano, micro, and macro games via reiterative shuffles in the game generation and shuffle process, as well as segregated variable indicia databases and a plucking algorithm.

A flowchart 175' associated with a preferred embodiment of the system 175 of FIG. 8 is provided in FIG. 9. As illustrated in the flowchart 175', the addition of the plucking algorithm 251 allows the micro, nano, and pico databases 250 to be accessed at different times than during the macro print run. The balancing of the prize funds at steps 230 through 234 and 241, 242, 235 still occurs prior to the macro print run, with the variable indicia imaging occurring at a later time.

Embodiments of the system 160 (FIG. 6) and the system 175 (FIG. 8) both illustrate links 163 between the inventory control data file 161 and the validation data file 162, as well as links 165 between the validation data file 162 and the variable indicia imager data file 164. From a security perspective, these links 163 and 165 are potentially problematic. The same potential security problems associated with multiple games accessing variable indicia imaging file(s) 164 as a persistent image on a server ahead of a press run(s) are present with links 163 between the ship file data 161 and the validation file data 162, as well as the links 165 between the validation file data 162 and the variable indicia imager file data 164. With the presently preferred embodiment 175, the variable indicia imager file data 164 are plucked real time and therefore, the security risks associated with the variable indicia imager file data 164 and its link 165 to the validation file data 162 are mitigated. However, the link 163 between the inventory control ship file data 161 and the validation file data 162 still persists in the preferred embodiment of system 175. If accessed by nefarious personnel, this link 163 could be exploited to determine winning tickets. Both the ship file 161 and the validation file 162 could be encrypted, with access to the decryption key closely guarded, but then internal and external audits potentially could prove problematic. In a preferred embodiment, the ship file data 161 are stored as plaintext and only the validation file data 162 are stored as ciphertext. This embodiment has the advantage of the plaintext ship file data 161 remaining accessible for audits with the link 163 to the validation file data 162 mitigated, since the data 162 are stored as ciphertext. If it is necessary to audit the validation file data 162, a separate cleartext audit validation file would be decrypted with its link 163 to the ship file data 161 broken and the validation file ticket-by-ticket order shuffled, preferably by a Linear Congruential Generator (LCG) or Mersenne Twister algorithm, both well known to those skilled in the art such that the original arrangement of the validation file ticket-by-ticket order cannot be deduced unless the shuffle algorithm's starting seed is known. Thus, with a special detached and shuffled validation file (i.e., without link 163) available for audit, the exact number of winners and losers may be readily audited, with the auditor unable to deduce the associated inventory control data since the link was broken, thereby maintaining security. As would be apparent to one skilled in the art in view of this disclosure, it may be necessary to redact portions of the validation file pointer information in the audit file, depending on the security requirements.

With standard instant ticket print runs, the prize fund itself is comprised of a percentage (e.g., 65%) of the total retail value of a game's print run—e.g., 10 million tickets with a retail value of $1 each—would have a 65% prize fund of $6,500,000. FIG. 10 provides an exemplary illustration of this typical, prior art example 200 with: 10 million tickets printed, at a retail cost of $1 each, with a 65% prize fund of $6.5 million, with overall odds of winning ≈1:6, and logistically broken down into ten pools of 1 million tickets each. The overall prize structure 201 for the entire game features ten prize levels ranging from $2 to $50,000. This overall prize structure is further broken down into ten pools 202 of one million tickets each. Thus, for a standard instant ticket run, the prizes are mostly evenly distributed among pools 202 with large top prize(s) being inserted into one or more pools. While the prize structure can vary from game-to-game, the essential concept is that a prize fund is established based on a percentage of the total projected retail value of the game with a portion of the prize fund ($645,000 in pool 202) being allocated to each pool (without a top prize present in every pool).

As a practical matter, instant lottery games rarely sell completely out, thus a portion of the anticipated revenue to the prize fund is usually missing. Typically, lotteries attempt to sell out in levels of pool quantization, thereby enabling ready balancing of the prize fund at the pool level with unsold pool prize payouts and revenue being deleted from the ledger.

In one embodiment, this general concept of balancing by pool can be extended to provide support for macro, micro, nano, and pico sized games. By reducing the pool size (e.g., one hundred) to accommodate the smallest game, each pool can represent a different game with revenue all rolled up into a shared common prize fund for the multiple games and sub games. FIG. 11 provides an example according to the present invention of one possible common prize fund supporting nano pool sizes, where multiple different games prizes are supported by at least one pool each. As shown in the figure, the same basic prize fund 203 as in FIG. 10 can be spread over multiple micro, nano, and pico games with each game buying into the prize fund via nano pools 204. In this example, the actual buy-in per game would be $42 with prizes distributed over multiple pools.

In another embodiment, the balancing can be achieved by reserving a small portion of the prize fund (e.g., 1%, 0.1%, etc.) from multiple games and sub games, wherein the reserved portion is pooled in a common progressive jackpot. This progressive jackpot could be similar to slot machines (e.g., U.S. Pat. Nos. 5,048,833; 5,280,909; 5,249,800; and, 8,348,754), where a macro, micro, nano, or pico instant ticket's top prize entitles the winner to a percentage of the accumulated progressive jackpot from multiple games and sub games. The common progressive jackpot value could be advertised by lotteries as an enticement for ticket sales with the winner of a "jackpot" in a macro, micro, nano, or pico instant ticket game entitling the holder to a percentage of the overall jackpot (e.g., 10%, 20%, 50%, or 100%). In a preferred embodiment, the percentage of the progressive jackpot that the winner receives is determined by the ticket retail price.

Figure 12:
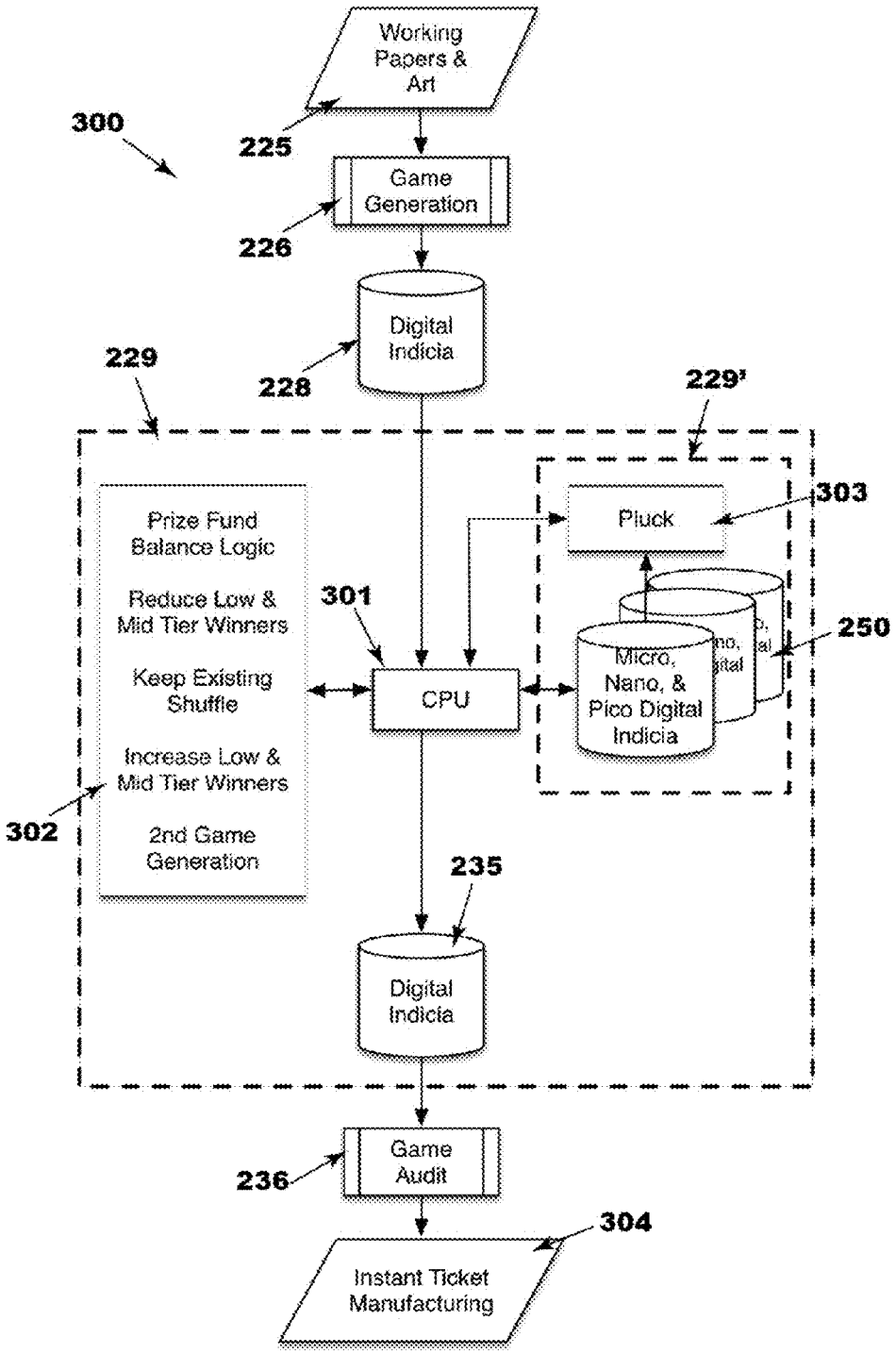

FIGS. 5, 7, 9, and 12 taken together, illustrate scalable prize funds enhancement embodiments, with a common corresponding system architecture flowchart diagram 300 illustrated in FIG. 12. In these figures, the added functionality unique to scalable prize funds enhancements is shown in dashed areas 229 and 229' with the typical existing game generation functionality outside of the dashed areas.

Referring to FIG. 12, the process begins, as previously with the flowcharts of FIGS. 5, 7 and 9, with generation of working papers and associated ticket artwork 225 that the lottery and any other purchasers agree and sign. The executed working papers and artwork 225 are then used to specify game generation programming at step 226. After game generation at step 226 is completed, variable indicia are digitally imaged at step 228 for each instant ticket of the print run and saved.

At this point, the additional digital computer processing 229 enabled by the disclosed invention is added to the instant ticket production process. This process can be conducted in a physically common server and Central Processing Unit (CPU) as the game generation at step 226 or executed on a separate server and CPU. Regardless of the physical implementation, the CPU 301 receives the generated game variable indicia and performs an audit to ultimately balance the prize fund. The logic associated with this prize fund balancing is resident in memory 302 as is the logic to reduce, keep, or increase the number of winners in the linked micro, nano, and/or pico games or sub games. After the audit and prize fund logic completes, the CPU 301 optionally (i.e., if the prize fund did not initially balance) completes a second game generation (logic also stored in memory 302) with the resulting modified digital variable indicia stored in database 235. This second game generation digital variable indicia database 235 is then audited at step 236 in a traditional process well known within the art with all other processes (e.g., physical printing, generation of ship file, etc.), proceeding as is standard for instant ticket manufacturing step 304.

In alternative and preferred embodiments of processing 229', multiple micro, nano, and pico digital indicia databases 250 are stored separately for future print runs, possibly seeded with extra winning variable indicia that can be culled or plucked at step 303 at the time of printing. The memory associated with the plucking algorithm at step 303 ideally is isolated from the memory of the reiterative game generation threads in memory 302 or in other game generation processes at step 228.

Of course, there are other variations of the disclosed embodiments (e.g., prize fund comprised exclusively of a large number of pico and nano games with no supporting macro game, pack size of one ticket, shared prize fund between multiple macro games, etc.) that would be apparent to anyone skilled in the art in view of this disclosure.

What is claimed is:

1. A computer-implemented method of generating game outcomes and a validation file that includes the game outcomes for an instant ticket game, wherein the instant ticket game includes at least two instant ticket sub games, each sub game having prize levels, and wherein a common prize fund is provided for the instant ticket game, the method comprising:

(a) generating game outcomes for the instant ticket game using a computer processor that performs a balancing process which either reduces or increases the number of low or mid-tier prizes in at least one of the sub games, the game outcomes for each of the instant ticket sub games being generated at the same time and each game result being associated with a unique validation number, the game outcomes being generated so that at least one of the sub games has prize levels that differ from the prize levels in another one of the sub games;

(b) generating by a server a first set of the game outcomes to a first one of the plurality of instant ticket sub games, and generating by the server a second set of game outcomes to a second one of the plurality of instant ticket sub games, each game outcome being either a winning ticket having a predefined monetary value, or a losing ticket having no monetary value, the total monetary value of the winning tickets being equal to the common prize fund;

(c) electronically shuffling the game outcomes by the computer processor performing divergent thread reiterative shuffles; and (d) creating a single validation file from the game outcomes using the computer processor, the single validation file including a record for each game outcome having a unique ticket validation number and the game outcome, the single validation file including the game outcomes for each of the instant ticket sub games.

2. The method of claim 1 wherein each instant ticket sub game has different game indicia, the method further comprising:

(e) printing instant tickets for each of the instant ticket sub games with their respective different game indicia; and (f) generating a single ship file from the single validation file for the printed instant tickets, wherein the single ship file includes a record for each printed instant ticket for each of the instant ticket sub games.

3. The method of claim 2 wherein the instant tickets for at least one of the sub games are printed at a later time than another one of the sub games, and wherein the single validation file and the single ship file includes virtual placeholder entries for game outcomes that have not yet been printed.

4. The method of claim 2 wherein winning or losing status of the printed instant tickets is displayed via printed variable indicia hidden under a Scratch-Off Coating (SOC) on unplayed printed instant tickets.

5. The method of claim 1 wherein the number of game outcomes for one of the subgames is one or more magnitudes greater than the number of game outcomes for another one of the subgames.

6. The method of claim 1 wherein the number of game outcomes for one of the subgames is multiple magnitudes greater than the number of game outcomes for another one of the subgames.

7. The method of claim 1 further comprising:

(e) dividing the sub games into packs with prize funds from the common prize fund balanced by grouping sets of packs into pools, wherein the pools are supportable by an Expected Value (EV) of the game.

8. The method of claim 1 further comprising:

(e) generating an interim variable image file for each sub game.

9. The method of claim 1 wherein in step (c), the game outcomes of each sub game are shuffled separately.

* * * * *